US009975264B2

(12) United States Patent
Weber et al.

(10) Patent No.: US 9,975,264 B2
(45) Date of Patent: May 22, 2018

(54) APPARATUS AND METHOD FOR SLICING FOOD PRODUCTS

(71) Applicant: Weber Maschinenbau GmbH Breidenbach, Breidenbach (DE)

(72) Inventors: Tobias Weber, Biedenkopf-Wallau (DE); Thomas Gaerber, Biedenkopf-Weifenbach (DE)

(73) Assignee: WEBER MASCHINENBAU GMBH BREIDENBACH, Breidenbach (DE)

( * ) Notice: Subject to any disclaimer, the term of this patent is extended or adjusted under 35 U.S.C. 154(b) by 123 days.

(21) Appl. No.: 14/577,137

(22) Filed: Dec. 19, 2014

(65) Prior Publication Data

US 2015/0224667 A1 Aug. 13, 2015

(30) Foreign Application Priority Data

Dec. 20, 2013 (DE) ..... 10 2013 114 664

(51) Int. Cl.
*B26D 7/32* (2006.01)
*B26D 7/06* (2006.01)

(52) U.S. Cl.
CPC ..... *B26D 7/32* (2013.01); *B26D 7/0625* (2013.01); *B26D 7/0683* (2013.01);
(Continued)

(58) Field of Classification Search
CPC ..... B26D 7/32; B26D 7/325; B26D 7/0625; B26D 7/0683; B26D 2007/322; B26D 2210/02; Y10T 83/0448; Y10T 83/2218; Y10T 83/2092; Y10T 83/2094; Y10S 83/932
See application file for complete search history.

(56) References Cited

U.S. PATENT DOCUMENTS 3,735,694 A * 5/1973 Richards ..... A22C 7/0015 242/DIG. 3
4,703,679 A * 11/1987 Hayashi ..... A21C 9/085 198/400

(Continued)

FOREIGN PATENT DOCUMENTS

DE 3019890 A1 11/1980
DE 19544764 A1 6/1997

(Continued)

*Primary Examiner* — Phong Nguyen
(74) *Attorney, Agent, or Firm* — Cantor Colburn LLP

(57) ABSTRACT

An apparatus for slicing food products is configured to supply products to be sliced to a cutting blade to slice the products into individual slices. The apparatus comprises a portioning unit for forming portions from slices falling down and comprises an engagement apparatus which is arranged in the region of the falling path of the slices and which is configured to influence the falling movement of the slices at least at times in order hereby to bring about a placement of the slices on the portioning unit in accordance with a desired placement shape. The engagement apparatus is adjustable during the slicing operation between a first configuration, in which it brings about a placement of the slices falling down in accordance with a first placement shape, and a second configuration, in which it brings about a placement of the slices falling down in accordance with a second placement shape differing from the first placement shape.

16 Claims, 15 Drawing Sheets

(52) U.S. Cl.
CPC ..... *B26D 2210/02* (2013.01); *Y10S 83/932* (2013.01); *Y10T 83/0448* (2015.04); *Y10T 83/2218* (2015.04)

(56) References Cited

U.S. PATENT DOCUMENTS

| | | | | |
|---|---|---|---|---|
| 5,724,874 | A | 3/1998 | Lindee et al. | |
| 7,832,316 | B2 * | 11/2010 | Weber | B26D 9/00 198/357 |
| 2007/0212464 | A1 * | 9/2007 | Maier | A22C 7/00 426/517 |
| 2007/0214923 | A1 * | 9/2007 | Maier | B26D 5/007 83/37 |
| 2013/0025425 | A1 * | 1/2013 | Knaupp | B26F 3/008 83/177 |

FOREIGN PATENT DOCUMENTS

| | | | |
|---|---|---|---|
| DE | 19935055 | A1 | 2/2001 |
| DE | 10358069 | A1 | 7/2005 |
| DE | 102004007671 | A1 | 9/2005 |
| EP | 0776740 | A1 | 6/1997 |
| JP | 06246690 | A | 9/1994 |
| JP | 2000263494 | A | 9/2000 |

* cited by examiner

APPARATUS AND METHOD FOR SLICING FOOD PRODUCTS

CROSS-REFERENCES TO RELATED APPLICATIONS

This application claims the priority of German Application No. 102013114664.3 filed on Dec. 20, 2013, which is incorporated herein by reference, in its entirety.

The present invention relates to an apparatus for slicing food products which is configured to supply products to be sliced on one track or on multiple tracks to a cutting blade moving in a cutting plane to slice the products into individual slices, comprising a portioning unit for forming portions from slices falling down and comprising an engagement apparatus which is arranged in the region of the falling path of the slices and which is configured to influence the falling movement of the slices at least at times in order hereby to bring about a placement of the slices on the portioning unit in accordance with a desired placement shape.

There is a desire for visually appealing placement designs in the manufacture of packed portions of sliced food products such as meat products, sausage products and cheese products. Whereas a free falling movement of the cut off slices from the cutting blade onto the portioning unit usually has the result that the slices come to lie areally over a product placement area of the portioning unit, provision can be made by means of an engagement apparatus projecting into the falling path of the slices or otherwise engaging therein that a different kind of placement of the slices takes place, e.g. a folded placement, a rolled placement, a wavy placement or a curled placement. Engagement apparatus for the folded placement of product slices are disclosed, for example, in DE 195 44 764 A1.

If a cutting apparatus such as a high-performance slicer is equipped with such an engagement apparatus, the device is set to the placement shape of the slices which can be brought about by the engagement apparatus. If therefore the engagement apparatus brings about a folded placement of the slices, for example, only portions can thus also be prepared having a uniform arrangement of folded slices. This is felt to lack flexibility by the operators of cutting apparatus.

There is therefore a need for cutting apparatus having increased flexibility with respect to the placement design of prepared portions.

This object is satisfied by an apparatus having the features of claim 1.

In accordance with the invention, the engagement apparatus is adjustable during the slicing operation at least between a first configuration, in which it brings about a placement of the slices falling down in accordance with a first placement shape, and a second configuration, in which it brings about a placement of the slices falling down in accordance with a second placement shape differing from the first placement shape.

Portions having different placement designs or placement patterns can thus be produced by means of one and the same cutting apparatus, that is for example, both portions with folded slices and portions with non-folded slices. A complex and/or expensive conversion or even a dismantling of the engagement apparatus is not required for this purpose. It is rather the case that, as required, the placement design for the portions can be changed in a simple and fast manner without shutting down the machine. This represents a considerable increase in productivity and flexibility for the operator of a food processing plant. It is also possible in principle to provide an engagement apparatus which is adjustable between three or more configurations during the slicing operation. All existing configurations do not necessarily have to correlate with different placement shapes in this respect. It is rather also conceivable to provide a change between three or more configurations, wherein e.g. only the placement shape of the first configuration differs from the placement shape of all other configurations. A configuration of the engagement apparatus in which the latter brings about a placement of the slices falling down in accordance with a desired placement shape can also comprise the engagement apparatus not influencing the falling movement of the slices at all because it is, for example, located completely outside the falling path. In this case, the slices come to be placed on the portioning unit in a completely uninfluenced manner, which can also correspond to a desired placement shape in the sense of the invention.

Further developments of the invention are set forth in the dependent claims, in the description and in the enclosed drawing.

The engagement apparatus is preferably adjustable from the first configuration into the second configuration, or vice versa, between two consecutive cuts of the cutting blade. This opens up the possibility of arranging two slices placed in different manners directly behind one another or overlapping one another on the portioning unit. A specific embodiment in this respect provides changing the configuration of the engagement apparatus after every cut or before every cut of the cutting blade. A portion or a product flow of slices placed differently in an alternating manner can hereby be prepared, which portion or which product flow has a visually particularly appealing placement design.

The engagement apparatus is preferably adjustable from the first configuration into the second configuration, or vice versa, at least once during the forming of a configuration. This can be effected, for example, by means of a corresponding control device which coordinates the engagement apparatus and a movable product placement area of the portioning unit with one another. The production of portions having a mixed placement shape is thereby possible. A portion can, for example, be formed which comprises both slices placed in a flat manner and folded slices. A portion can in particular be produced in which folded slices and non-folded slices are arranged alternatingly overlapping over one another.

A further embodiment of the invention provides that the engagement apparatus is adjustable between the first configuration and the second configuration in dependence on the temporal progress of the cutting movement of the cutting blade. In other words, the cutting movement of the cutting blade and the adjustment procedure of the engagement apparatus can be synchronized in a suitable manner. Such a synchronization can in turn be brought about by an electronic control device. A mechanical coupling of the cutting blade drive to a drive of an adjustment device of the engagement apparatus is, however, also possible in principle.

In accordance with a specific embodiment of the invention, the first configuration is an active configuration in which the engagement apparatus influences the slices falling down, whereas the second configuration is an inactive configuration in which the engagement apparatus does not influence the slices falling down. Without an influencing of the slices falling down by the engagement apparatus, the slices are usually placed on the associated product placement area in a flat manner. This is a very acceptable placement shape in many cases. In contrast, the other placement shape, which is produced from a contact between the engagement apparatus and the slices falling down, can be a folded placement, a rolled placement, a wavy placement or a curled placement.

The engagement apparatus can in particular be configured to influence the falling movement of the slices in at least one configuration such that a folded placement of the slices on the portioning unit takes place. A sequence of differently folded slices or an alternating sequence of folded and non-folded slices can then, for example, be produced by an adjustment of the engagement apparatus during the slicing process.

The portioning unit preferably comprises a portioning conveyor for transporting the slices away in a removal apparatus, wherein a control device of the portioning conveyor is configured to vary the conveying speed and/or the conveying direction of the portioning conveyor in dependence on the configuration of the engagement apparatus; and/or wherein the engagement apparatus and the portioning unit can be operated coordinated with one another by means of a control device such that the engagement apparatus and the portioning unit together influence the slices falling down. Overlapping or stacked portions can generally be prepared by means of a portioning conveyor. A coordinated operation of such a portioning conveyor and of an adjustment device of the engagement apparatus allows the automatic preparation of a variety of placement designs. With an overlapping portion, for example, which comprises folded and non-folded slices in an alternating arrangement, a uniform overlap is generally desired. Such a uniform overlap is not possible in the case of a mixture of folded and non-folded slices without a variation of the conveying speed of the portioning conveyor due to the differently positioned front edges.

A further embodiment of the invention provides that the portioning conveyor is transversely displaceable and/or rotatable about an axis of rotation with respect to the removal direction. This makes the possibilities for the preparation of different placement designs more difficult.

An embodiment of the invention provides that the engagement apparatus can be moved into the falling path of the slices as a whole to bring about the first configuration and can be moved out of the falling path of the slices as a whole to bring about the second configuration, in particular in the removal direction or transversely to the removal direction of a portioning conveyor of the portioning unit. This makes possible in a particularly simple manner a change between slices placed down folded and slices placed down non-folded. The engagement apparatus can be linearly displaceable as an autonomous unit and/or can be pivotably supported at a base frame of the cutting apparatus for this purpose.

Alternatively or additionally, the engagement apparatus can comprise a base part fastened to the portioning unit or to a base frame of the apparatus and an operative element connected to the base part to influence the falling movement, wherein the operative element can be moved relative to the base part to vary the configuration of the engagement apparatus. Since in this respect only the comparatively small mass of the operative element has to be accelerated, the mechanical strain on the components of the engagement apparatus is also small in particularly fast adjustment procedures.

The engagement apparatus can be pivotable about a pivot axis extending in parallel with the cutting plane to change between the first configuration and the second configuration. The pivot axis can in this respect in particular extend vertically. A pivot movement allows particularly fast adjustment processes.

A further embodiment of the invention provides that the cross-sectional shape of the engagement apparatus is variable to change its configuration. The total engagement apparatus then does not have to be moved out of the falling region of the slices to avoid an influencing of the falling movement. It is rather sufficient only to adapt the cross-sectional shape of the engagement apparatus, which can take place particularly fast.

The engagement apparatus can, for example, comprise a belt conveyor or strap conveyor, wherein a belt guide of the belt conveyor or strap conveyor can be varied for varying the configuration of the engagement apparatus and/or wherein at least one slider which is provided at the belt side can be moved in or out of the falling path of the slices by a conveying movement of the belt into the falling path of the slices. This is advantageous to the extent that it is not the total belt conveyor or strap conveyor, including the relatively heavy drive, which has to be moved. It is e.g. sufficient to move two rollers of the conveyor relative to one another while maintaining the band tension. Such a tensioned belt arrangement allows a particularly fast change between different configurations since, for example, a retraction of the working edge of the belt conveyor by a relatively small amount is sufficient to suppress any contact of the belt with the slices falling down. Slicers provided at the belt side can be engagement elements which project from the support surface of the belt and which are movable by a control of the belt. Such sliders can be configured in dependence on the application as rails, bars, sections, bosses or the like. The size or height and/or the cross-sectional shape of a slider can in this respect be adapted to a specific kind of product. A specific embodiment provides that a plurality of differently shaped sliders are attached to one and the same belt in the belt movement direction at a spacing from one another and are movable into the falling region of the slices in dependence on the kind of product just being sliced or in dependence on the application.

The engagement apparatus can comprise an engagement rotor rotatable about an axis of rotation. This embodiment allows a particularly fast change between the different configurations. The engagement rotor can be configured in the manner of rollers, rails or bars; if necessary, however, it can also have a more complex shape. Depending on the application, a continuous rotation in one direction of rotation or an alternating rotation "forward and backward" can be provided for the engagement rotor. In accordance with a specific embodiment of the invention, the axis of rotation of the engagement rotation extends substantially at right angles to the falling path of the slices and/or at right angles to the removal direction of a portioning conveyor.

The engagement rotor can have an outer diameter varying in the peripheral direction and/or an outer side asymmetrical with respect to the axis of rotation. During the rotation, the regions of the engagement rotor furthest remote from the axis of rotation thus e.g. move into the falling path of the slices at times. For example, the engagement rotor could have an elliptical cross-section and/or be eccentrically supported. This allows a particularly simple construction.

Provision can be made that the axis of rotation of the engagement rotor is arranged inclined with respect to the cutting plane and/or that the engagement rotor is pivotable about a pivot axis extending at right angles to the axis of rotation. An engagement rotor inclined or set with respect to the cutting plane is able to effect a folded placement of the slices each with a folding edge extending obliquely to the removal direction. Particularly appealing placement designs can be achieved by means of such an "oblique folding". With a pivotable engagement rotor, the angle of inclination can be varied during the formation of a portion in order thus to influence the extent of the fold edges. It can be advantageous with a multitrack cutting apparatus to select different angles of inclination for at least two tracks. In principle, an oblique folding is also possible with a non-rotating bar whose bar axis is arranged inclined with respect to the cutting plane.

At least one eccentric cam element can be provided at the engagement rotor. Such a cam element can also be subsequently attached to a symmetrical engagement rotor to give the engagement rotor adjustability. In principle, a plurality of cam elements can also be provided distributed along the periphery of the engagement rotor to allow a multiple change between different configurations of the engagement rotor on each rotation of the engagement rotor. Respective cam elements—of the same or different designs—could in particular be attached at two opposite sides of the engagement rotor A radially movable and/or axially movable engagement element can be provided at an outer side of the engagement rotor. The engagement rotor can then, for example, be arranged such that no influencing of the slices falling down takes place with a moved in engagement element. An influencing of the falling movement of the slices can thus take place by a controlled moving out of the engagement element as desired and thus a changed placement shape can be brought about. The engagement element can e.g. be of half-shell form.

A specific embodiment of the invention provides that the engagement apparatus comprises at least two telescopic parts. For example, a rotatingly driven outer part of an engagement rotor can be pushed forward and backward guided at an inner part in the axial direction to change between the configurations.

The engagement apparatus can comprise a inflatable casing. The position of the effective outer surface of the engagement apparatus in this respect depends on the inflation state of the casing. That is, it is possible to displace the outer dimensions of the engagement apparatus by a controlled pressurizing of the casing, for example by means of compressed air, and thus to move it into the falling path of the slices as required. A fast reduction of the outer dimensions of the engagement apparatus can subsequently take place again by a controlled release of the compressed air. If the engagement apparatus is a rotor, the compressed air supply can in particular be realized via the central region of the axis of rotation.

The engagement apparatus can furthermore comprise a blowing device, in particular at least one blowing nozzle, preferably a nozzle bar and/or a nozzle lance, for the selective blowing of a fluid, in particular compressed air, onto a slice falling down, wherein a control device is configured to change the fluid quantity blown out by the blowing device in the direction of the slices falling down or to change the blowing strength to vary the configuration of the engagement apparatus, i.e. of the blowing device. The air supply to the blowing device can, for example, be switched on or off to change between a folded placement and a non-folded placement of the slices falling down. Different flow pulses or a change in the direction of flow can, however, also serve for influencing the placement shape. The adjustment of the engagement apparatus between the at least two different configurations can here therefore generally take place by setting different operating modes of the blowing device forming the engagement apparatus. A configuration change via a blowing direction control can be carried out particularly fast.

The engagement apparatus can comprise an elongate deformation element whose longitudinal ends are anchored at respective fastening points of the cutting apparatus, wherein the spacing of the fastening points can be varied to change the configuration of the engagement apparatus. A reduction of the spacing of the fastening points effects an arching or "bulging" of the deformation element. With a suitable arrangement, this bulging actually has the result that the central region of the deformation element projects into the falling path of the slices and so influences the placement shape. In the stretched state, the deformation element can, in contrast, be located completely outside the falling path and therefore not influence the placement shape of the slices. It is also possible that the elongate deformation element influences the falling movement of the slices both in the extended state and in the bulged state—but in different ways. Depending on the application, the elongate deformation element can rotate about its longitudinal axis or not during the operation of the cutting apparatus.

The elongate deformation element can comprise a flexible, in particular elastic, hoop and/or an articulated arm arrangement. The deflection of the hoop or the angular position of the articulated arms of the articulated arm arrangement can be varied by changing the spacing of the fastening points in order thus to influence the falling slices in different manners.

The invention also relates to a method for slicing food products, in particular by means of an apparatus as described above, in which products to be sliced are supplied on one track or on multiple tracks to a cutting blade moving in a cutting plane to slice the products into individual slices, and portions are formed on a portioning unit from slices falling down, wherein the falling movement of the slices is influenced at least at times by means of an engagement apparatus arranged in the region of the falling path of the slices in order hereby to bring about a placement of the slices on the portioning unit in accordance with a desired placement shape.

Provision is made in accordance with the invention that the engagement apparatus is adjusted during the slicing operation at least between a first configuration, in which it brings about a placement of the slices falling down in accordance with a first placement shape, and a second configuration, in which it brings about a placement of the slices falling down in accordance with a second placement shape differing from the first placement shape. In this manner, different placement designs or placement patterns can be produced on one and the same machine without conversion work.

The engagement apparatus is preferably adjusted from the first configuration into the second configuration, or vice versa, between two consecutive cuts of the cutting blade. No interruption of the cutting sequence of any kind is thus necessary to change the placement shape.

It is furthermore preferred that the engagement apparatus is adjusted at least once from the first configuration into the second configuration, or vice versa, during the forming of a portion. Portions mixed with respect to the placement shape can thereby be prepared, for example overlapping portions of folded and non-folded slices which are visually particularly appealing.

The engagement apparatus can in particular be adjusted between the first configuration and the second configuration in dependence on the temporal progress of the cutting movement of the cutting blade.

In accordance with a specific embodiment of the invention, the falling movement of the slices is influenced in at least one configuration such that a folded placement of the slices on the portioning unit takes place.

The slices can in particular be placed down folded with the engagement apparatus located in the first configuration and can be placed down uninfluenced by the engagement apparatus located in the second configuration, in particular non-folded, with an engagement apparatus located in the second configuration.

The slices placed on the portioning unit can furthermore be transported away on a portioning conveyor, wherein the conveying speed and/or the conveying direction of the portioning conveyor is/are selected in dependence on the configuration of the engagement apparatus. Portions with a desired placement design can be prepared in a deliberate manner by such a coordination of the operation of the portioning conveyor, on the one hand, and of the adjustment state of the engagement apparatus, on the other hand.

The engagement apparatus and the portioning unit can in particular be operated in coordination with one another such that the engagement apparatus and the portioning unit together influence the slices falling down. The engagement apparatus itself can, for example, act as a conveyor which is operated in the opposite sense to a conveyor of the portioning unit and only acts on a front part region of the slices viewed in the removal direction. The front part of a slice is thus moved against the removal direction by the engagement apparatus, whereas the rear part of the slice already located on the portioning conveyor is moved in the removal direction. A reliable folded placement of the slice can hereby be ensured.

An independent aspect of the invention provides that products supplied on multiple tracks, in particular products of different types, are sliced, wherein portions are formed which comprise both slices, e.g. of a first product type, placed in accordance with a first placement shape, and slices, e.g. of a second product type, placed in accordance with the second placement shape. The flexibility with respect to the portion design can hereby be further expanded. For this purpose, each track can have its own engagement apparatus which can each be adjustable during the slicing operation, with this not being compulsory, however.

In accordance with a further independent aspect of the invention, an apparatus for the multitrack slicing of food products is provided which is configured to supply products to be sliced on multiple tracks to a cutting blade moving in a cutting plane to slice the products into individual slices. The apparatus comprises a portioning unit for forming total portions from slices falling down in the individual tracks and comprises at least one engagement apparatus in each track arranged in the region of the falling path of the slices which is in each case configured to influence the falling movement of the slices in the respective track at least at times in order hereby to bring about a placement of the slices on the portioning unit in accordance with a desired placement shape. Provision is made in this respect that an engagement apparatus adopts a first configuration in at least one first track during the slicing operation, in which configuration it brings about a placement of the slices of the respective track falling down in accordance with a first placement shape and that an engagement apparatus adopts a second configuration in at least one second track during the slicing operation, in which configuration it brings about a placement of the slices of the respective track falling down in accordance with a second placement shape differing from the first placement shape.

The different placement shapes are therefore not produced by an adjustment of an engagement apparatus during the slicing operation in accordance with this aspect of the invention, but rather by engagement apparatus being individual per track in different tracks, with this engagement apparatus being able to be, but not having to be, non-adjustable.

In this respect, means for combining the individual portions to a total portion can additionally be provided.

The invention will be described in the following by way of example with reference to the drawings.

Figure 1:
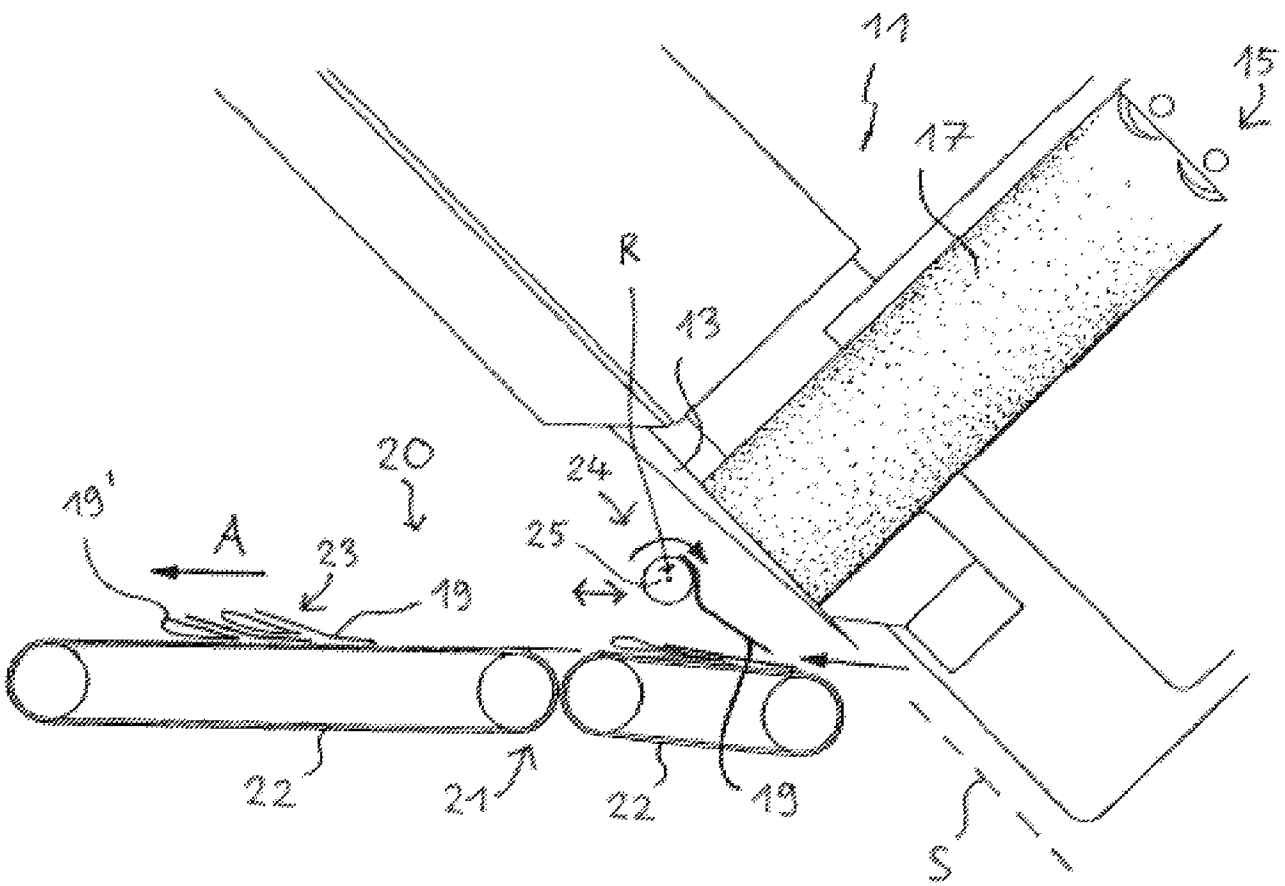
FIG. 1 shows a simplified side view of an apparatus in accordance with the invention for slicing food products.
Figure 4:
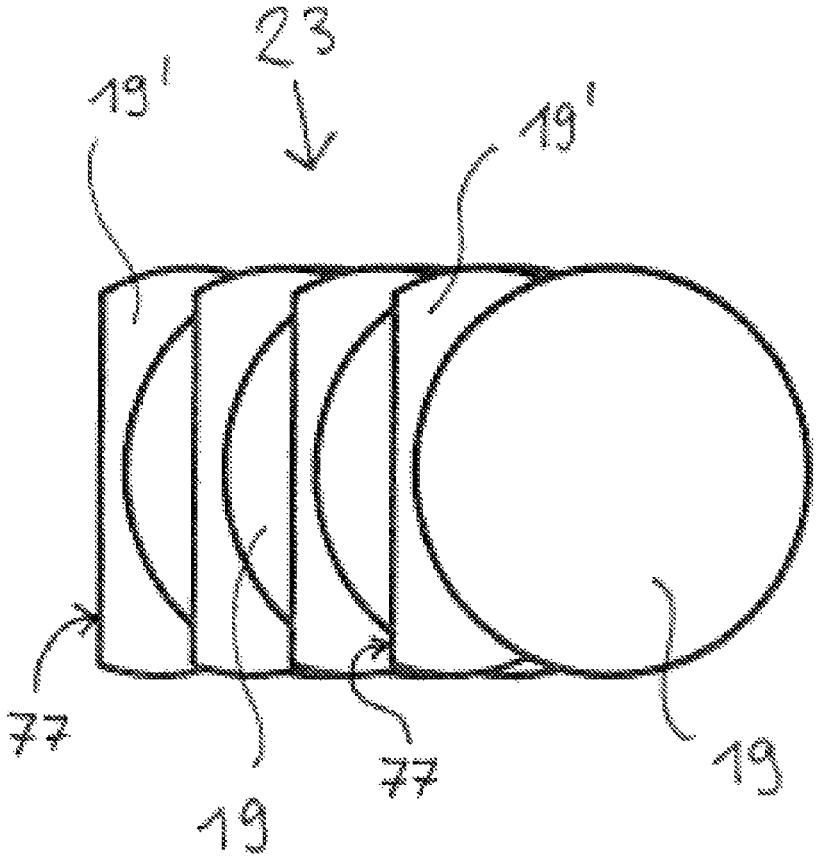
Figure 5:
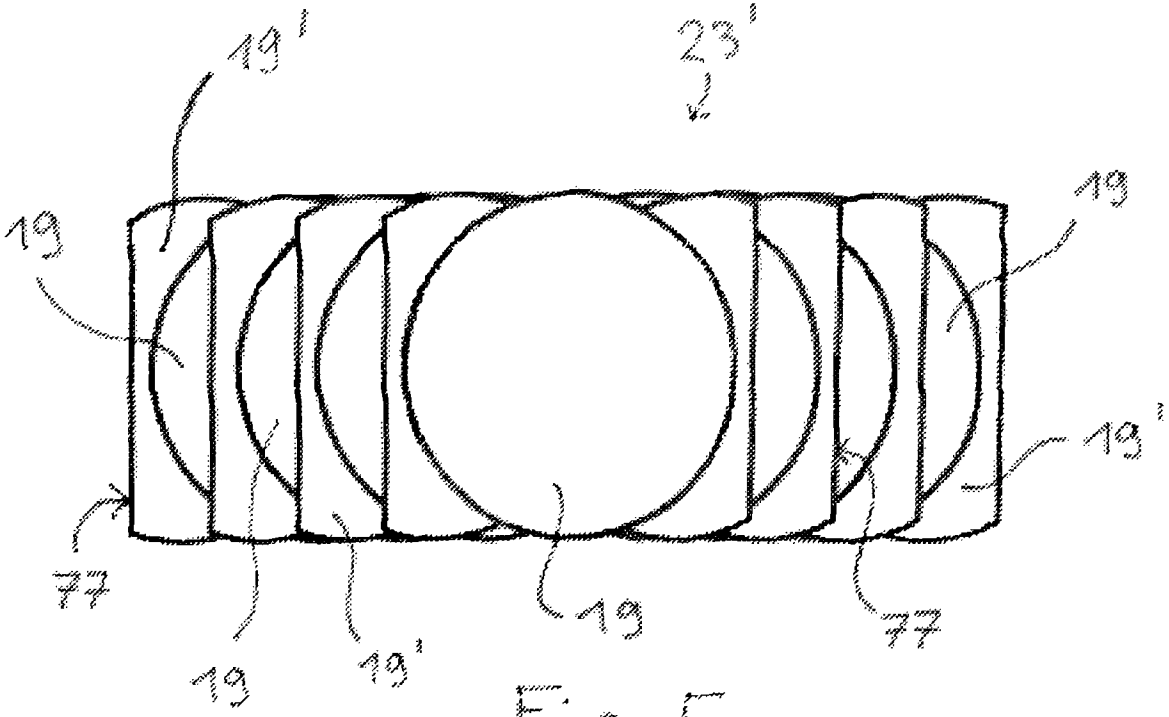
Figure 6:
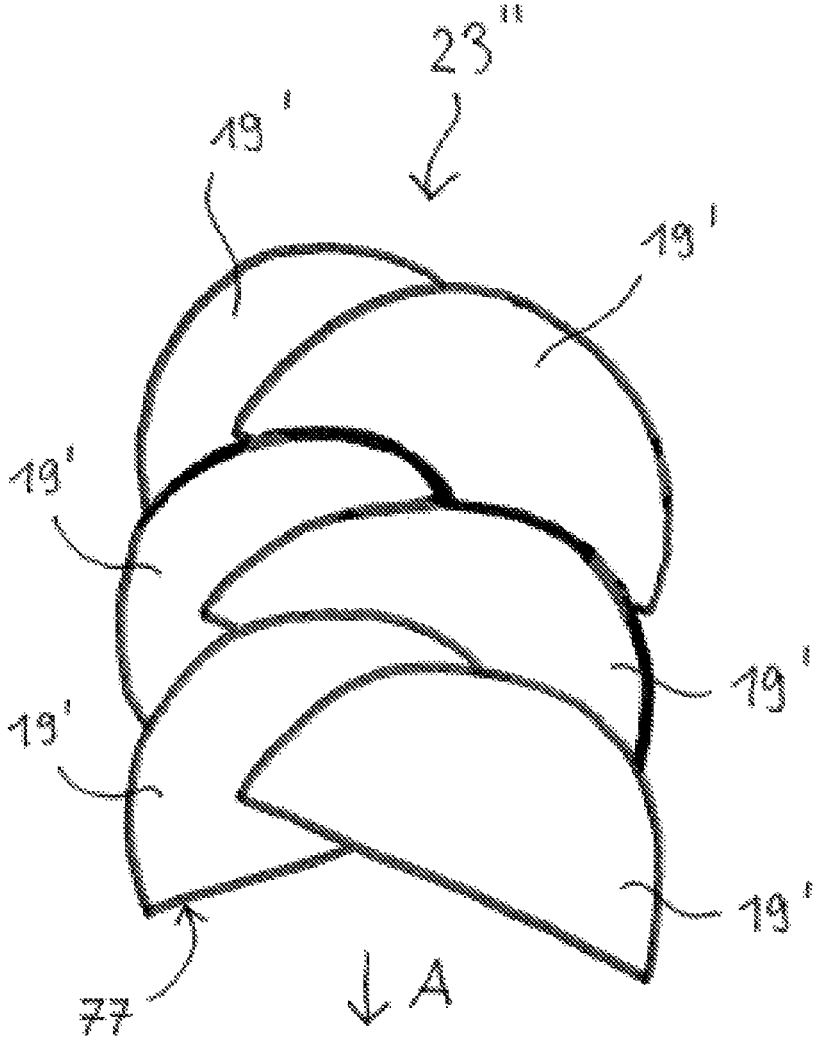
Figure 7C:
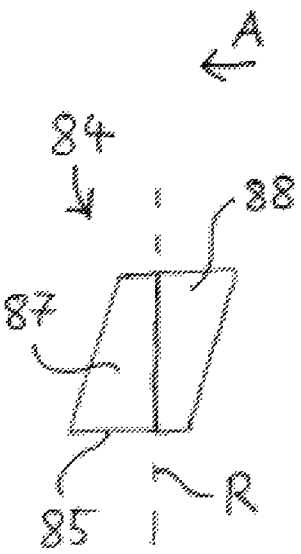
Figure 7B:
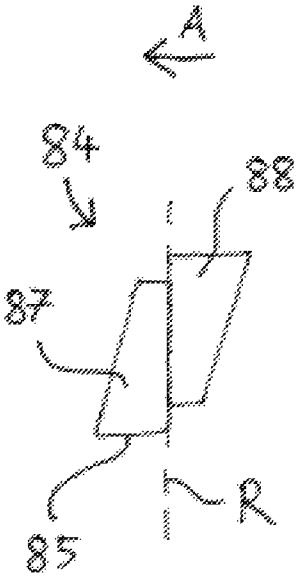
Figure 7A:
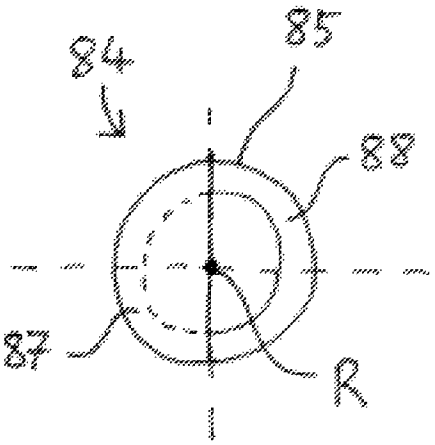
Figure 8:
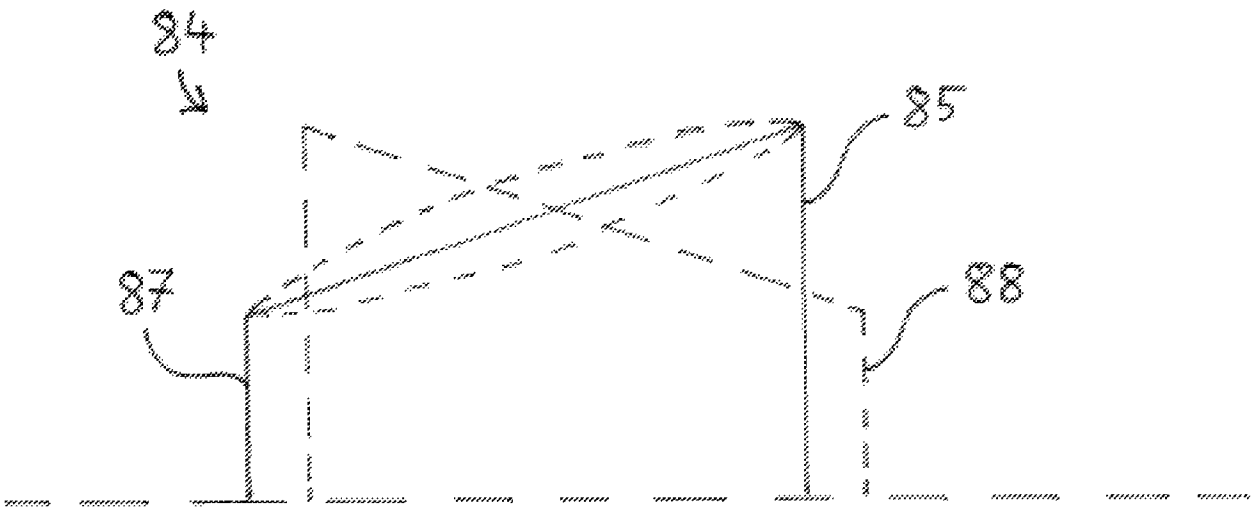

FIGS. 3*a*-3*e* show different variants of engagement apparatus for an apparatus in accordance with the invention for slicing food products;

FIG. 4 shows a plan view of a portion of cut-off slices of food product slices which was produced by an apparatus in accordance with FIG. 1;

FIG. 5 shows a plan view of a portion of cut-off slices of food product slices which was produced by an alternatively designed apparatus in accordance with the invention;

FIG. 6 shows a plan view of a portion of cut-off slices of food product slices which was produced by an again alternatively designed apparatus in accordance with the invention;

FIG. 7*a* shows a front view of an engagement apparatus which is suitable for producing portions as shown in FIG. 6;

FIG. 7*b* shows a plan view of the engagement apparatus in accordance with FIG. 7*a* in a first configuration;

FIG. 7*c* shows a plan view of the engagement apparatus in accordance with FIG. 7*b* in a second configuration;

FIG. 8 is a schematic diagram of the engagement apparatus in accordance with FIG. 7*b;*

Figure 9:
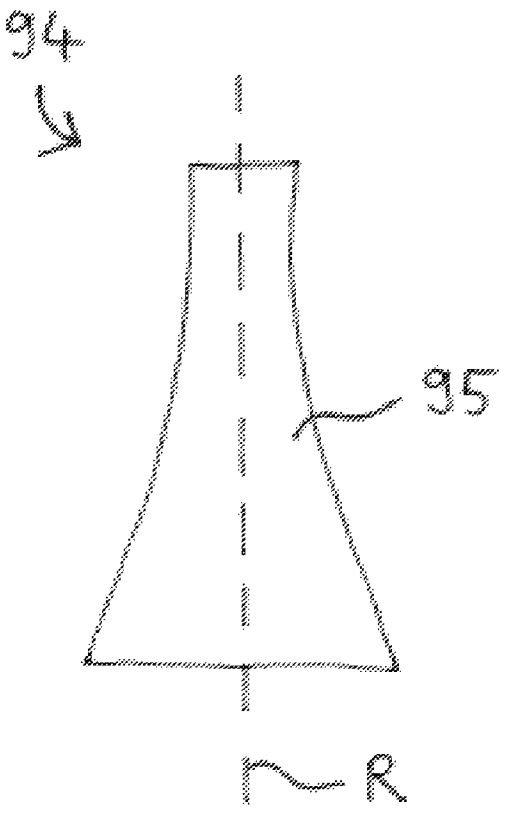
Figure 10:
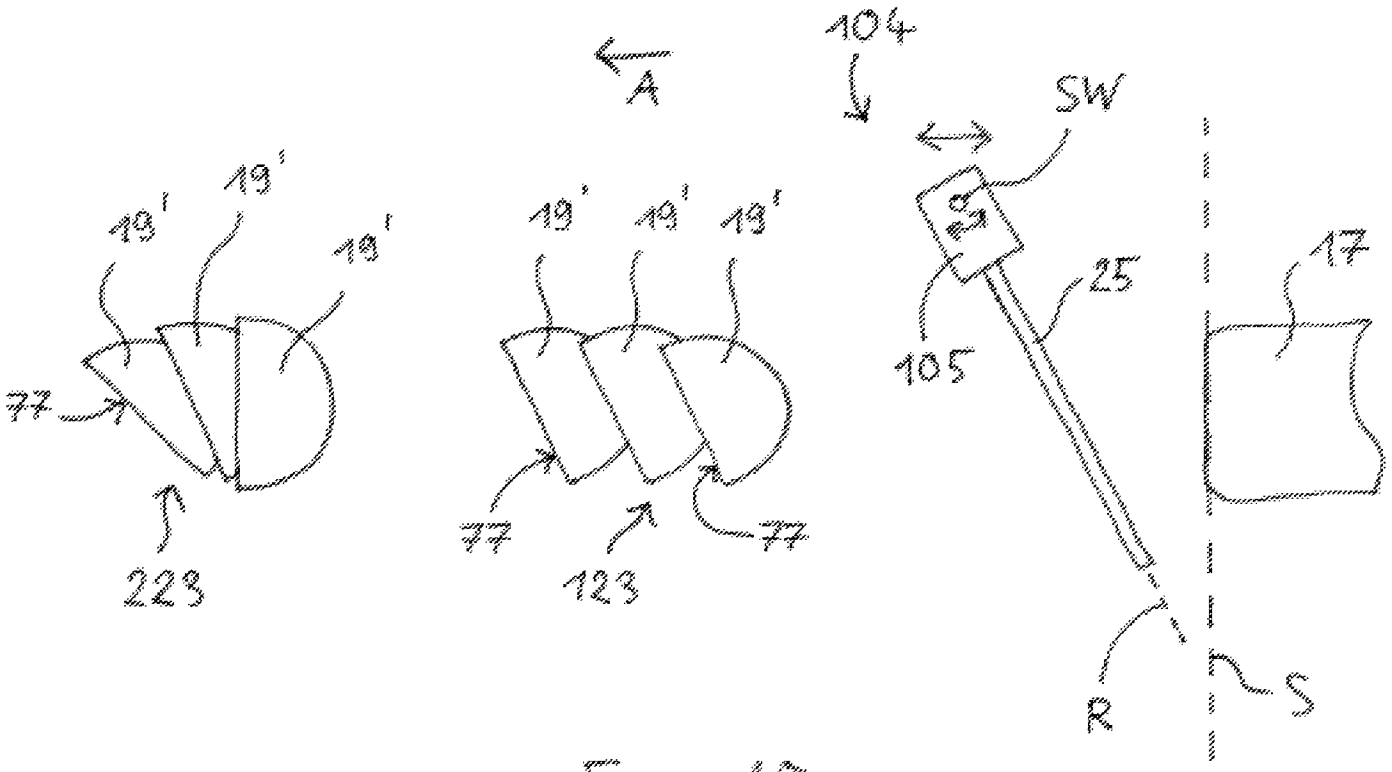
Figure 11:
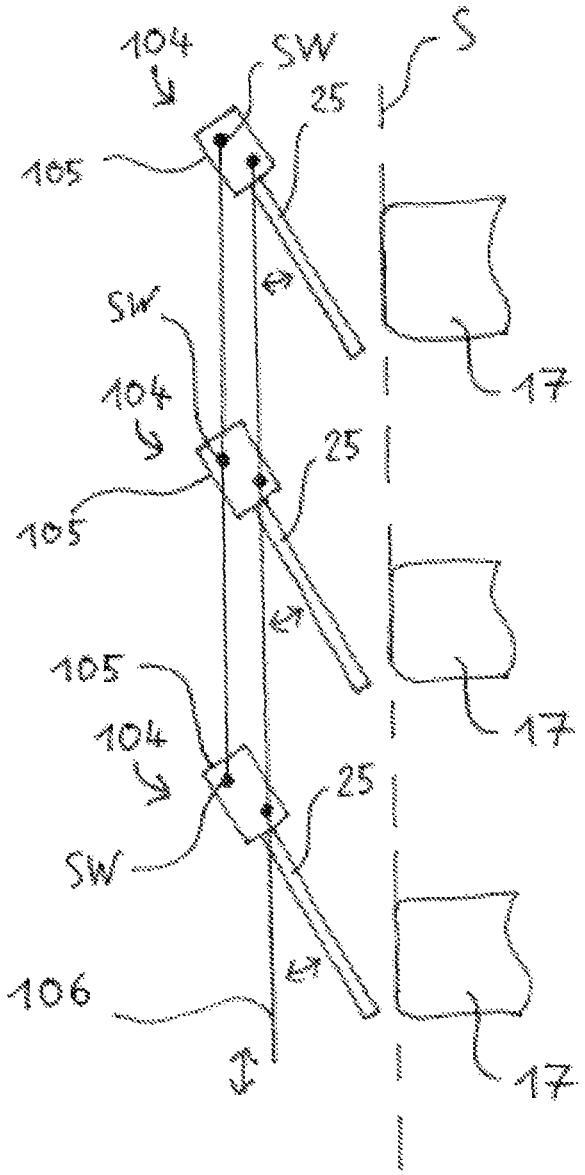
Figure 12:
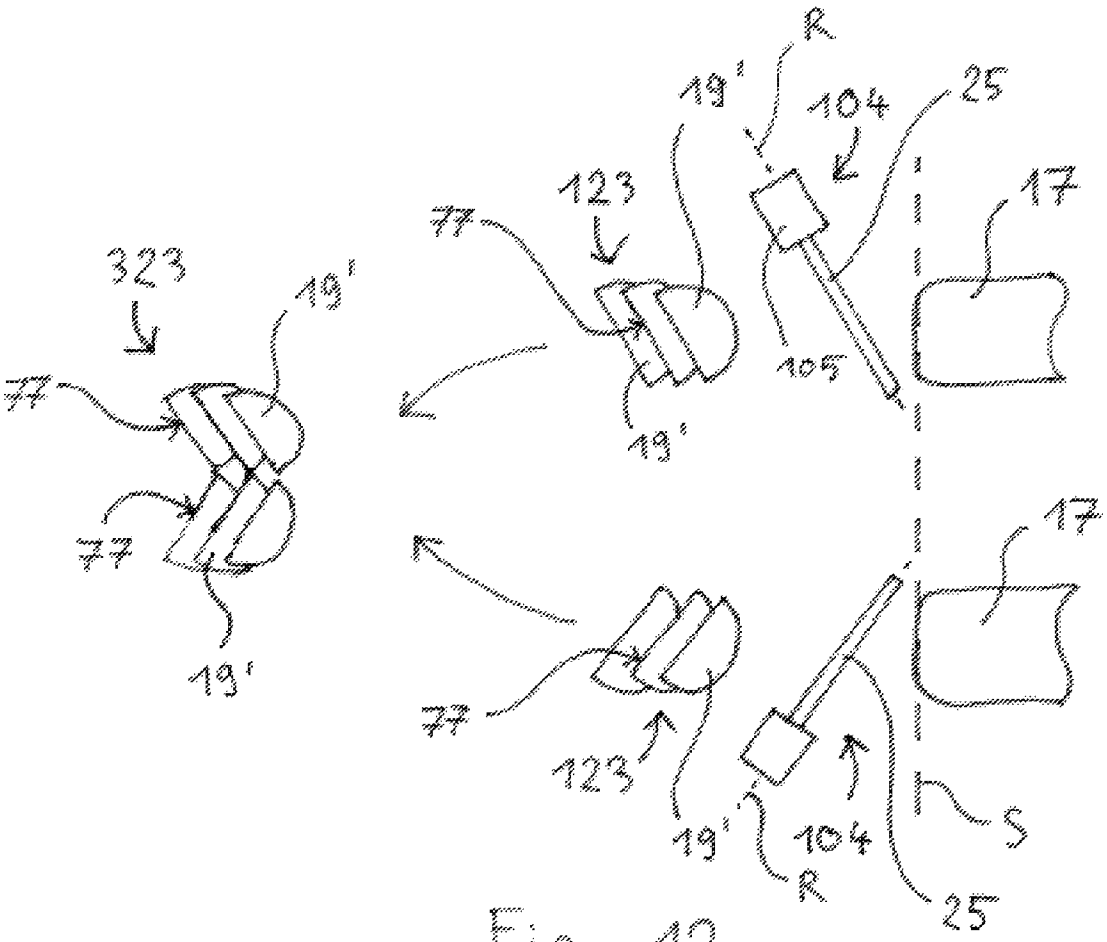
Figure 13B:
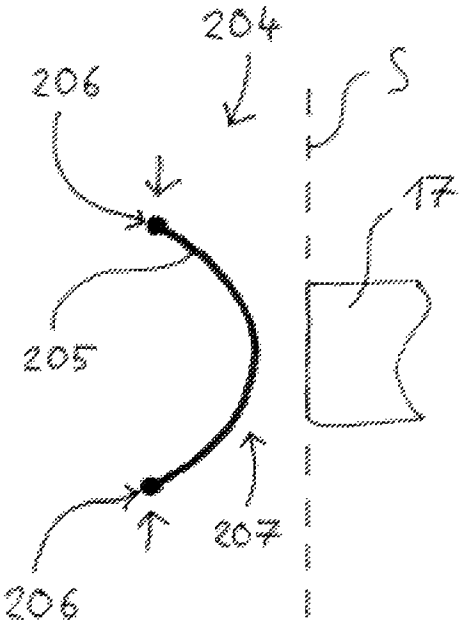
Figure 13A:
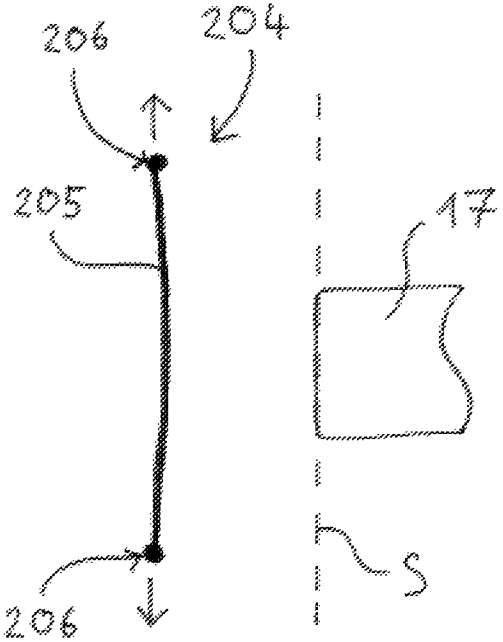
Figure 14B:
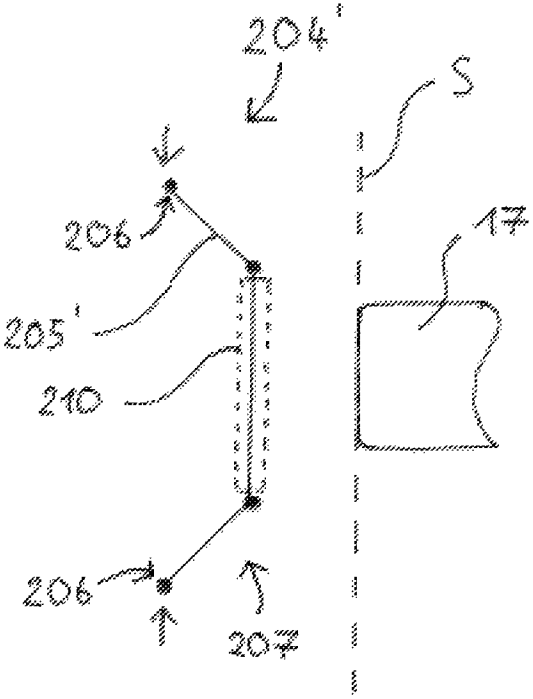
Figure 14A:
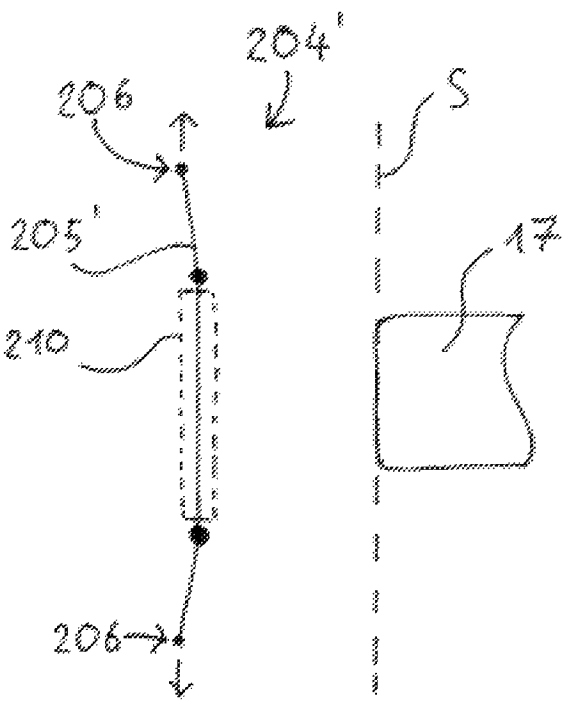

FIG. 9 shows a further engagement apparatus for an apparatus in accordance with the invention for slicing food products;

FIGS. 10-12 show plan views of further apparatus in accordance with the invention for slicing food products;

FIG. 13*a* shows a plan view of an apparatus for slicing food products in accordance with a further embodiment of the invention, wherein a wire hoop of an engagement apparatus is located in a non-engagement position;

FIG. 13*b* shows the apparatus in accordance with FIG. 13*a* with a wire hoop located in an engagement position;

FIG. 14*a* shows a plan view of an apparatus for slicing food products in accordance with a further embodiment of the invention, wherein an articulated arm arrangement of an engagement apparatus is located in a non-engagement position; and FIG. 14*b* shows the apparatus in accordance with FIG. 14*a* with an articulated arm arrangement located in an engagement position.

FIG. 1 shows a high-performance slicer 11 having a cutting blade 13 which moves in a cutting plane S—for example in a rotating manner and or in a planetary motion. A product supply 15 of the high-performance slicer 11 serves to supply product bars or product loaves 17 lying on it automatically to the cutting plane S in order thus to effect a repeated cutting off of slices 19 from the product bar 17. Depending on the size of the cutting blade 13, a plurality of product bars 17 located next to one another can also be supplied simultaneously to the cutting plane S, which is called "multitrack operation". The slices 19 falling down land on a portioning unit 20 which is here configured as a portioning conveyor 21. The portioning conveyor 21 comprises an arrangement of belt conveyors or strap conveyors 22 which conveys the slices 19 away from the cutting blade 13 along a removal direction A. It is possible to vary the conveying speed and the conveying direction of the portioning conveyor 21 as required by means of an electronic control device, not shown, of the portioning unit 20 in order thus to produce portions 23 having a desired placement design, that is, for example, overlapping or stacked portions 23.

An engagement apparatus 24 is configured to influence the falling movement of the slices 19 at least at times is arranged in the region of the falling path of the slices 19 in order hereby to place the slices 19 on the portioning conveyor 21 in a specific manner. In the embodiment in accordance with FIG. 1, the engagement apparatus 24 is configured as an engagement rotor 25 which is driven rotatably and in an opposite sense to the removal direction A about an axis of rotation R extending at right angles to the removal direction A. The engagement rotor 25 is thus able to bring about a folded placement of the slices 19 in cooperation with the portioning conveyor 21, as is generally known from DE 195 44 764 A1.

To be able to prepare not only portions with slices 19' placed folded, but also portions 23 with slices 19 placed non-folded using the high-performance slicer 11 shown in FIG. 1, the engagement rotor 25, including the support and the drive, both not shown, is displaceable in and against the removal direction A, as is illustrated by the double arrow. Starting from the active configuration shown in FIG. 1, the engagement rotor 25 can be moved completely out of the falling path of the slices 19 by displacing it so that an influencing of the slices 19 falling down no longer takes place by the engagement rotor 25. If the engagement rotor 25 is located in such an inactive configuration, a non-folded, flat placement of the slices 19 on the portioning conveyor 21 takes place.

An actuator, which is not shown and is preferably electrical, hydraulic or pneumatic is able to adjust the engagement rotor 25 from the active configuration into the inactive configuration or vice versa during the slicing operation and in particular between two consecutive cuts of the cutting blade 13. Portions 23 can thus be produced which are formed by an alternating sequence of folded and non-folded slices 19, 19'. In order in this respect to ensure the shown uniform overlap within a portion 23, it may be necessary to operate the portioning conveyor 21 by a predetermined amount against the removal direction A after each slice 19 placed down flat to compensate that offset which results due to the front half of a slice 19 which is turned back on folding. The portioning conveyor 21 can also be displaceable transversely to the removal direction A or rotatable about a vertical axis, whereby further possibilities for placement designs result.

Figure 2:
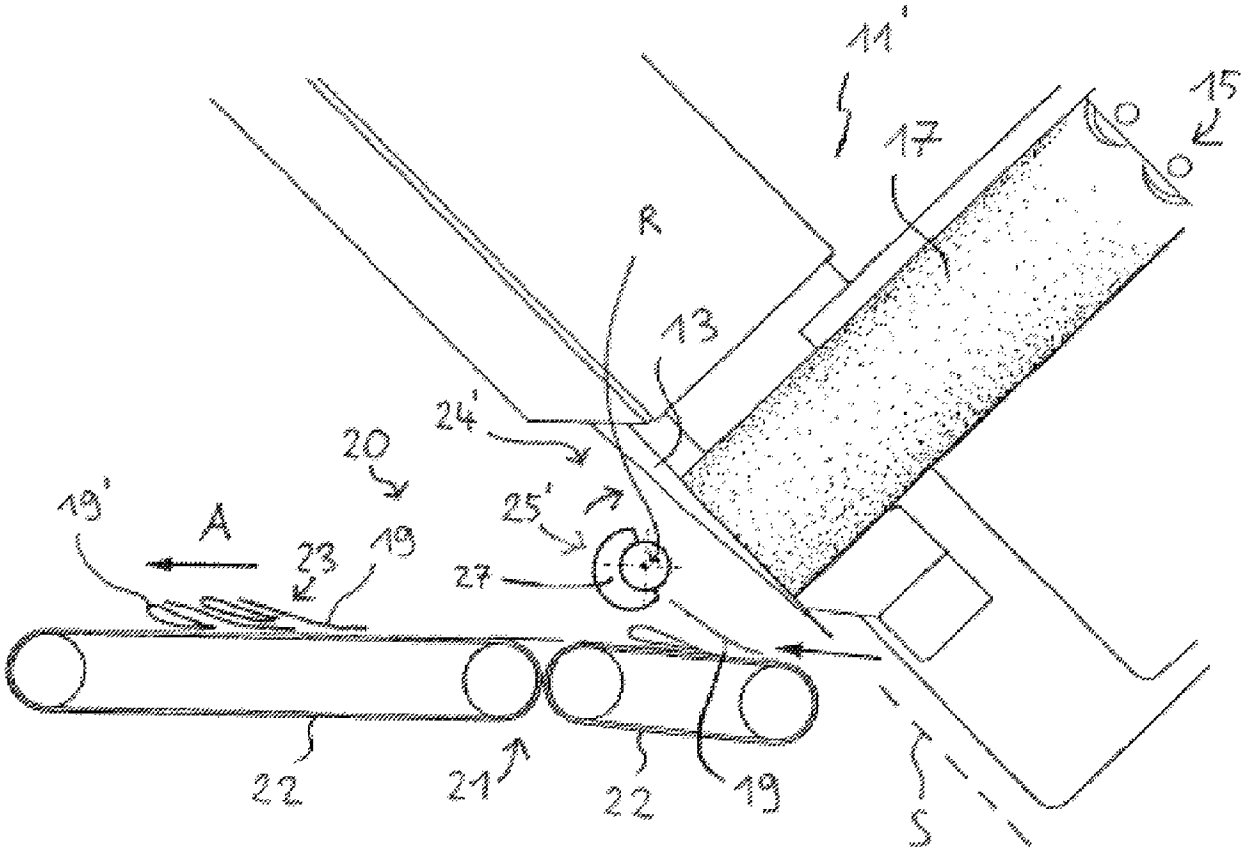
FIG. 2 shows an alternative embodiment of an apparatus in accordance with the invention for slicing food products.

FIG. 2 shows an alternative embodiment of a high-performance slicer 11' in accordance with the invention which has a similar design to the previously described high-performance slicer 11. Accordingly, components having the same effect are provided with the same reference numerals. The engagement apparatus 24' in the form of the engagement rotor 25' is, however, immovably fastened to a base frame of the high-performance slicer 11', not shown, in the embodiment in accordance with FIG. 2. The adjustment between the active configuration and the inactive configuration takes place by an eccentric cam element 27 which is provided at the engagement rotor 25' and which projects either into the falling path of the slices 19 or not in dependence on the rotational position of the engagement rotor 25'. In this embodiment, only relatively smaller masses have to be moved so that a particularly fast change is possible between the active configuration and the inactive configuration. If the cutting blade 13 is a cutting blade driven in a rotating or revolving manner, the rotational speed of the engagement rotor 25' should be selected in direct dependence on the rotational speed of an associated blade shaft. It is specifically preferred that an engagement rotor 25' having a single cam element 27, as shown in FIG. 2, revolves at half the rotational blade speed. With two cam elements 27 arranged opposite one another, it would in contrast be preferred that the engagement rotor 25' only rotates at a quarter of the rotational blade speed.

Figure 3A:
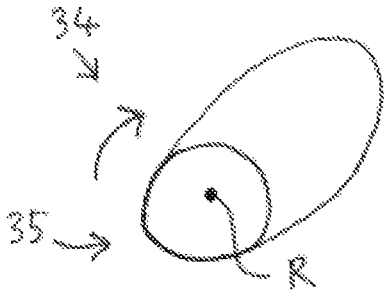
Figure 3B:
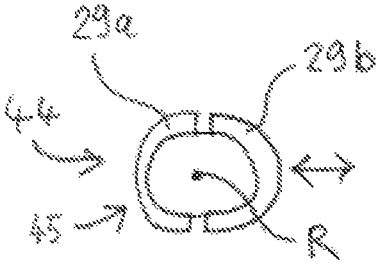
Figure 3C:
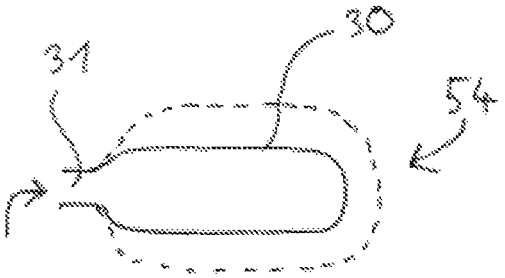

FIGS. 3*a* to 3*e* show by way of example further possible embodiments for an adjustable engagement apparatus. FIG. 3*a* specifically shows an engagement apparatus 34 in the form of an engagement rotor 35 in which an asymmetrical cross-section, in elliptical form here, is generally provided instead of a separate cam element. In accordance with FIG. 3*b*, the engagement rotor 45 of an engagement apparatus 44 is composed of two half-shell elements 29*a*, 29*b*. It can be achieved by a radial moving apart of the half-shell elements 29*a*, 29*b* that the previously inactive engagement rotor 45 reaches into the falling path of the slices 19 and influences it. FIG. 3*c* shows an embodiment in which the engagement apparatus 54 comprises an inflatable casing 30. The outer diameter of the casing 30 can be increased so much by supply of compressed air via a supply line 31 that the previously inactive casing 30 projects into the falling path of the slices 19 and from then on influences their falling movement. The outer diameter of the casing 30 can be reduced again by a controlled release of the compressed air from the casing.

Figure 3D:
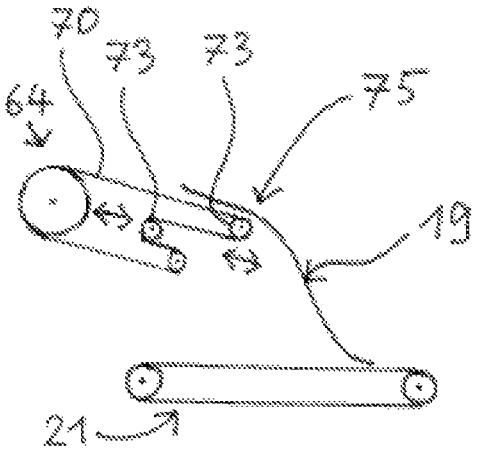

A belt conveyor 64 is shown in FIG. 3*d* which forms an adjustable engagement apparatus. As shown by the double arrows, the position of individual rollers 73 of the belt conveyor 64 and thus the belt guide of the belt conveyor 64 is variable. In this manner, the working edge 75 of the belt 70 can be moved in and out of the falling path of the slices 19 while maintaining the belt tension. A movement of the total belt conveyor 64 including its drive is therefore not necessarily required.

Figure 3E:
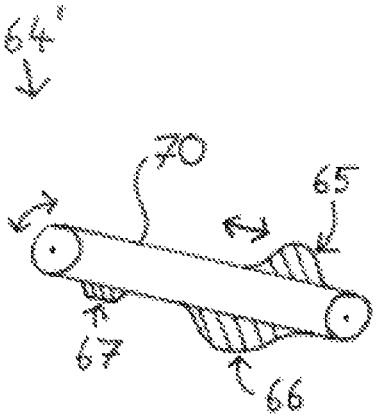

In the embodiment shown in FIG. 3*e*, a belt conveyor 64' is likewise provided as an engagement apparatus. Three sliders 65, 66, 67 each having different cross-sectional shapes are attached to the outer side of the belt 70. Further sliders can be provided as required. As illustrated by the double arrows, the sliders 65, 66, 67 can be moved in and against the conveying direction by a correspondingly controlled belt drive of the belt conveyor 64'. The belt conveyor 64' is positioned such that each of the sliders 65, 66, 67 can be moved into or out of the falling path of the slices 19 by a travel movement of the belt 70. The cross-sectional shape of the sliders 65, 66, 67 is respectively adapted to a specific product type or application or to a respective desired placement shape.

It is understood that a number of further possibilities are conceivable in dependence on the respective application to move an engagement apparatus 24 as a whole or only a component or an operative surface thereof out of the falling path of the slices 19 or into the falling path of the slices 19. In all cases, a fast change of the engagement apparatus 24 from an active configuration into an inactive configuration or vice versa is possible during the regular slicing operation.

The invention in particular allows the automatic preparation of overlapping portions 23 in which folded slices 19' and non-folded slices 19 are arranged alternately. An example for such a portion is shown in FIG. 4.

In the portion 23' shown in FIG. 5, a row of folded slices 19' and non-folded slices 19 overlapping to the right and a row of folded slices 19' and non-folded slices 19 overlapping to the left are placed next to one another in a symmetrical arrangement. An individually non-folded slice 19 is located in the center of the arrangement. Such symmetrical portions 23' can be achieved by displacing an engagement rotor such as the engagement rotor 25 shown in FIG. 1 in the removal direction A (FIG. 1). The symmetrical arrangement of two or more overlapping individual portions of folded slices 19' and non-folded slices 19 can take place using a turntable associated with the portioning unit 20. Alternatively or additionally, two overlapping individual portions, which each comprise folded slices 19' and non-folded slices 19, can be positioned symmetrically next to one another or behind one another by means of an overlapper or inserter disposed downstream of the high-performance slicer 11, in particular in accordance with FIG. 5, such that the folding edges 77 of the folded slices 19' of the one individual portion adjoin the folding edges 77 of the folded slices 19' of the other individual portion.

The operation of the individual components or assemblies, in particular of the engagement apparatus 24, 24' and of the portioning conveyor 21 coordinated in dependence on the respective application takes place by one or more control devices (not shown) which are connected to or integrated in a central control of the slicer 11, 11'.

FIG. 6 shows a portion 23" of folded slices 19' arranged overlapping, wherein the folding edges 77 of the folded slices 19' each extend obliquely to the removal direction A. As shown, the folding edges 77 are inclined in different directions with respect to the removal direction A, wherein the differently inclined extents of the folding edges 77 alternate with slices 19' placed down after one another.

Such portions 23" can, for example, be prepared using an engagement apparatus 84 shown in FIGS. 7*a-c* and 8. It is in this respect an engagement rotor 85 which is composed of two separate cam elements 87, 88. The cam elements 87, 88 each have a half-tapered or half-conical base shape and are arranged oppositely with respect to the extent of the cone. A folding edge 77 is thus produced which is inclined clockwise or anti-clockwise with respect to the cutting plane S (FIG. 6) depending on the rotational position of the engagement rotor 85. The rotational speed of the engagement rotor 85 can be adapted such that the two cam elements 87, 88 engage alternately into the falling path of the slices 19. To achieve an offset between slices placed down consecutively which is also lateral with respect to the removal direction A, the two cam elements 87. 88 are displaceable with respect to one another in an axial direction with respect to the axis of rotation R of the engagement rotor 85, as can be recognized in FIGS. 7*b* and 7*c*. In the schematic diagram in accordance with FIG. 8, optional modifications of the conical form for one of the cam elements 87 is shown in dashed lines. The outer surface of the cam elements 87, 88 can accordingly also be slightly arched, inwardly or outwardly depending on the application.

FIG. 9 shows a further embodiment for an engagement apparatus 94 which is configured as a single-part engagement rotor 95 having an inwardly arched conical shape.

The engagement apparatus 104 shown in FIG. 10 has a base body 105 and an elongate engagement rotor 25 projecting from the base body 105. As shown, the axis of rotation R of the engagement rotor 25 is inclined with respect to the cutting plane S so that the folding edges 77 of the placed down slices 19' also accordingly extend obliquely to the cutting plane S. The base body 105 of the engagement apparatus 104 is pivotable about a vertical pivot axis SW and is additionally displaceable in and against the removal direction A, as is indicated by double arrows in FIG. 10. It is understood that numerous different placement designs can be produced by means of the engagement apparatus 104 on the basis of this adjustability. A portion 123 having folding edges 77 extending in parallel and a portion 223 having folding edges 77 extending inclined to one another are shown by way of example in FIG. 10.

FIG. 11 shows a cutting plane S to which product bars 17 are supplied on three tracks. An engagement apparatus 104 which is designed like the engagement apparatus 104 shown in FIG. 10 is associated with each track. To allow a common pivoting of the engagement rotors 25 of the engagement apparatus 104, the base bodies 105 of the engagement apparatus 104 are coupled to one another by a coupling linkage 106.

In accordance with FIG. 12, the engagement rotors 23 of different tracks can also be inclined differently. In the example shown, the axes of rotation R of two adjacent engagement rotors 25 are arranged symmetrically in order thus to produce part portions 123 having symmetrically extending folding edges 77. The two part portions 123 can then be combined to a total portion 323 in which the folding edges 77 come into contact with laterally adjacent slices 19' in the manner of an arrow.

FIGS. 13*a* and 13*b* show a further embodiment for an engagement apparatus 204. The engagement apparatus 204 is configured here as an elongate deformation element in the form of an elastically flexible wire hoop 205. The wire hoop 205 is anchored at respective fastening points 206 of a suitable frame (not shown) in the region of its longitudinal ends. If the spacing between the two fastening points 206 is reduced, starting from the extended base position shown in FIG. 13*a*, the wire hoop 205 bends, as shown in FIG. 13*b*, and forms a bulge 207 which projects into the falling path of the slices 19. A change can thus be made between a folded and a non-folded slice placement by varying the spacing between the two fastening points 206. The wire hoop 205 can be rigid or can be rotatable abut its longitudinal axis. A rotatability of the wire hoop 205 about the fastening points 206, on the one hand, allows a pivoting away of the bent wire hoop 205 out of the falling path and, on the other hand, a temporary pivoting along of the wire hoop 205 with a falling slice 19. Exactly adapted degrees of slice influencing can be achieved by adjusting the wire hoop 205 into intermediate positions.

Alternatively to a wire hoop, an articulated arm arrangement 205' as shown in FIGS. 14*a* and 14*b* can also be provided which forms an elongate deformation element of an engagement apparatus 204'. Such an articulated arm arrangement 205' in a similar manner forms a bulge 207 like the wire hoop 205 shown in FIGS. 13*a* and 13*b* on a reduction of the spacing of the fastening points 206. The central section of the articulated arm arrangement 205' can support a rotatably supported sleeve 210.

REFERENCE NUMERAL LIST

11, 11' high-performance slicer
13 cutting blade

15 product supply
17 product bar
19, 19' slice
20 portioning unit
21 portioning conveyor
22 belt conveyor or strap conveyor
23, 23', 23" portion
24, 24' engagement apparatus
25, 25' engagement rotor
27 cam element
29*a*, 29*b* half-shell element
30 casing
31 supply line
34 engagement apparatus
35 engagement rotor
44 engagement apparatus
45 engagement rotor
54 engagement apparatus
64, 64' belt conveyor
65, 66, 67 slider
70 belt
73 roller
75 working edge
77 folding edge
84 engagement apparatus
85 engagement rotor
87, 88 cam element
94 engagement apparatus
95 engagement rotor
104, 104' engagement apparatus
105 base body
106 coupling linkage
123 portion
204, 204' engagement apparatus
205, 205' deformation element
206 fastening point
207 bulge
210 sleeve
223 portion
323 portion
A removal direction
S cutting plane
R axis of rotation
SW pivot axis

The invention claimed is:

1. An apparatus for slicing food products which is configured to supply products to be sliced on one track or on multiple tracks to a cutting blade moving in a cutting plane to slice the products into individual slices, comprising a portioning unit for forming portions from slices falling down and comprising an engagement apparatus which is arranged in the region of the falling path of the slices and which is configured to influence the falling movement of the slices at least at times in order hereby to bring about a placement of the slices on the portioning unit in accordance with a desired placement shape, the engagement apparatus being adjustable during the forming of a portion, the forming of a portion comprising arranging a plurality of slices, the engagement apparatus adjustable at least between a first configuration, in which it brings about a placement of the slices falling down in accordance with a first placement shape, and a second configuration, in which it brings about a placement of the slices falling down in accordance with a second placement shape differing from the first placement shape, the first configuration being an active configuration in which the engagement apparatus influences the slices falling down, whereas the second configuration is an inactive configuration in which the engagement apparatus does not influence the slices falling down, and a control device of the apparatus configured to adjust the engagement apparatus at least once from the active configuration into the inactive configuration, or vice versa, during the forming of a portion;

in which the engagement apparatus comprises an engagement rotor rotatable about an axis of rotation, the engagement apparatus having an outer diameter varying in at least one of a peripheral direction and an axial direction.

2. The apparatus in accordance with claim 1, in which the engagement apparatus is adjustable from the first configuration into the second configuration or vice versa between two consecutive cuts of the cutting blade.

3. The apparatus in accordance with claim 1, in which the engagement apparatus is adjustable between the first configuration and the second configuration in dependence on the temporal progress of the cutting movement of the cutting blade.

4. The apparatus in accordance with claim 1, in which the engagement apparatus is configured to influence the falling movement of the slices in at least one configuration such that a folded placement of the slices on the portioning unit takes place.

5. The apparatus in accordance with claim 1, in which the portioning unit comprises a portioning conveyor for transporting away the slices in a removal direction, wherein a control device of the portioning conveyor is configured to vary at least one of a conveying speed and a conveying direction of the portioning conveyor in dependence on the configuration of the engagement apparatus.

6. An apparatus for slicing food products which is configured to supply products to be sliced on one track or on multiple tracks to a cutting blade moving in a cutting plane to slice the products into individual slices, comprising a portioning unit for forming portions from slices falling down and comprising an engagement apparatus which is arranged in the region of the falling path of the slices and which is configured to influence the falling movement of the slices at least at times in order hereby to bring about a placement of the slices on the portioning unit in accordance with a desired placement shape, the engagement apparatus being adjustable during the forming of a portion, the forming of a portion comprising arranging a plurality of slices, the engagement apparatus adjustable at least between a first configuration, in which it brings about a placement of the slices falling down in accordance with a first placement shape, and a second configuration, in which it brings about a placement of the slices falling down in accordance with a second placement shape differing from the first placement shape, the first configuration being an active configuration in which the engagement apparatus influences the slices falling down, whereas the second configuration is an inactive configuration in which the engagement apparatus does not influence the slices falling down, and a control device of the apparatus configured to adjust the engagement apparatus at least once from the active configuration into the inactive configuration, or vice versa, during the forming of a portion;

in which the engagement apparatus comprises an engagement rotor rotatable about an axis of rotation, in which at least one eccentric cam element is provided at the engagement rotor.

7. The apparatus in accordance with claim 6, in which the engagement apparatus is adjustable from the first configuration into the second configuration or vice versa between two consecutive cuts of the cutting blade.

8. The apparatus in accordance with claim 6, in which the engagement apparatus is adjustable between the first configuration and the second configuration in dependence on the temporal progress of the cutting movement of the cutting blade.

9. The apparatus in accordance with claim 6, in which the engagement apparatus is configured to influence the falling movement of the slices in at least one configuration such that a folded placement of the slices on the portioning unit takes place.

10. The apparatus in accordance with claim 6, in which the portioning unit comprises a portioning conveyor for transporting away the slices in a removal direction, wherein a control device of the portioning conveyor is configured to vary at least one of a conveying speed and a conveying direction of the portioning conveyor in dependence on the configuration of the engagement apparatus.

11. An apparatus for the multitrack slicing of food products which is configured to supply products to be sliced on multiple tracks to a cutting blade moving in a cutting plane to slice the products into individual slices, comprising a portioning unit for forming total portions from slices falling down in the individual tracks, and comprising at least one engagement apparatus in each track which is arranged in the region of the falling path of the slices and which is configured to influence the falling movement of the slices in the respective track at least at times in order hereby to bring about a placement of the slices on the portioning unit in accordance with a desired placement shape, an engagement apparatus adopting a first configuration in at least one first track during the forming of a first partial portion, the forming of the first partial portion comprising arranging a first plurality of slices, the first configuration of the engagement apparatus providing a placement of the first plurality of slices of the respective track falling down in accordance with a first placement shape; and an engagement apparatus adopting a second configuration in at least one second track during the forming of a second partial portion, the forming of the second partial portion comprising arranging a second plurality of slices, the first partial portion and the second partial portion forming a total portion, the second configuration of the engagement apparatus providing a placement of the second plurality of slices of the respective track falling down in accordance with a second placement shape differing from the first placement shape, the first configuration being an active configuration in which the engagement apparatus influences the slices falling down, whereas the second configuration is an inactive configuration in which the engagement apparatus does not influence the slices falling down, in which the engagement apparatus comprises an engagement rotor rotatable about an axis of rotation, the engagement rotor having an outer diameter varying in at least one of a peripheral direction and an axial direction.

12. The apparatus in accordance with claim 11, wherein means for combining the individual portions into a total portion are provided.

13. The apparatus in accordance with claim 11, in which the engagement rotor has an outer side asymmetrical with respect to the axis of rotation.

14. An apparatus for the multitrack slicing of food products which is configured to supply products to be sliced on multiple tracks to a cutting blade moving in a cutting plane to slice the products into individual slices, comprising a portioning unit for forming total portions from slices falling down in the individual tracks, and comprising at least one engagement apparatus in each track which is arranged in the region of the falling path of the slices and which is configured to influence the falling movement of the slices in the respective track at least at times in order hereby to bring about a placement of the slices on the portioning unit in accordance with a desired placement shape, an engagement apparatus adopting a first configuration in at least one first track during the forming of a first partial portion, the forming of the first partial portion comprising arranging a first plurality of slices, the first configuration of the engagement apparatus providing a placement of the first plurality of slices of the respective track falling down in accordance with a first placement shape; and an engagement apparatus adopting a second configuration in at least one second track during the forming of a second partial portion, the forming of the second partial portion comprising arranging a second plurality of slices, the first partial portion and the second partial portion forming a total portion, the second configuration of the engagement apparatus providing a placement of the second plurality of slices of the respective track falling down in accordance with a second placement shape differing from the first placement shape, the first configuration being an active configuration in which the engagement apparatus influences the slices falling down, whereas the second configuration is an inactive configuration in which the engagement apparatus does not influence the slices falling down, in which the engagement apparatus comprises an engagement rotor rotatable about an axis of rotation, in which at least one eccentric cam element is provided at the engagement rotor.

15. The apparatus in accordance with claim 14, wherein means for combining the individual portions into a total portion are provided.

16. The apparatus in accordance with claim 14, in which the engagement rotor has an outer side asymmetrical with respect to the axis of rotation.

* * * * *